US011299378B2

(12) United States Patent
Kou et al.

(10) Patent No.: US 11,299,378 B2
(45) Date of Patent: Apr. 12, 2022

(54) DOUBLE-DRUM INTERMEDIATE GEAR LINKAGE WINDING TYPE HOISTING SYSTEM

(71) Applicants: TAIYUAN UNIVERSITY OF TECHNOLOGY, Shanxi (CN); Pingdingshan Tianan Coal Mining Co., Ltd, Henan (CN)

(72) Inventors: Ziming Kou, Taiyuan (CN); Xingzi Tu, Pingdingshan (CN); Yandong Wang, Taiyuan (CN); Juan Wu, Taiyuan (CN); Xiaoniu Zhang, Pingdingshan (CN); Huaxin Chen, Pingdingshan (CN); Lipeng Zhu, Taiyuan (CN); Li'nan Zhang, Taiyuan (CN); Bo Huang, Pingdingshan (CN); Jian Lin, Pingdingshan (CN)

(73) Assignees: TAIYUAN UNIVERSITY OF TECHNOLOGY, Taiyuan (CN); Pingdingshan Tianan Coal Mining Co., Ltd, Pingdingshan (CN)

( * ) Notice: Subject to any disclaimer, the term of this patent is extended or adjusted under 35 U.S.C. 154(b) by 5 days.

(21) Appl. No.: 16/874,744

(22) Filed: May 15, 2020

(65) Prior Publication Data

US 2021/0300736 A1 Sep. 30, 2021

(30) Foreign Application Priority Data

Mar. 30, 2020 (CN) ..... 202010239670.4
Mar. 30, 2020 (CN) ..... 202020434779.9

(51) Int. Cl.
*B66D 1/26* (2006.01)
*B66D 1/48* (2006.01)
(Continued)

(52) U.S. Cl.
CPC ..... *B66D 1/26* (2013.01); *B66D 1/485* (2013.01); *B66D 1/56* (2013.01); *B66D 1/12* (2013.01);
(Continued)

(58) Field of Classification Search
CPC ... B66D 1/26; B66D 1/56; B66D 1/12; B66D 1/485; B66D 5/02; B66D 2700/0141; B66D 2700/0166; B66D 2700/025
See application file for complete search history.

(56) References Cited

U.S. PATENT DOCUMENTS 273,835 A * 3/1883 Harry ..... B66D 1/26 254/295
938,027 A 10/1909 Suplee
(Continued)

FOREIGN PATENT DOCUMENTS

CN 104340811 A 2/2015
CN 104709796 A 6/2015
(Continued)

OTHER PUBLICATIONS

Office Action of the Australian application No. 2020202801, dated Dec. 23, 2020, 7 pgs.

*Primary Examiner* — Michael E Gallion
(74) *Attorney, Agent, or Firm* — Cooper Legal Group, LLC

(57) ABSTRACT

A double-drum linkage winding type hoisting system includes a first hoisting drum and a second hoisting drum. The first hoisting drum and the second hoisting drum are engaged and linked through engagement structures on outer circumferences of the first hoisting drum and the second hoisting drum or are linked through a linkage intermediate member. A first hoisting rope is wound around the first hoisting drum. A second hoisting rope is wound around the
(Continued)

second hoisting drum. The first hoisting rope and the second hoisting rope are not connected with each other.

8 Claims, 4 Drawing Sheets

(51) Int. Cl.
*B66D 1/56* (2006.01)
*B66D 5/02* (2006.01)
*B66D 1/12* (2006.01)

(52) U.S. Cl.
CPC ..... *B66D 5/02* (2013.01); *B66D 2700/0141* (2013.01); *B66D 2700/0166* (2013.01); *B66D 2700/025* (2013.01)

(56) References Cited

U.S. PATENT DOCUMENTS 1,248,600 A * 12/1917 Bathrick ..... B66D 1/26 254/310
1,389,324 A * 8/1921 Stevenson ..... B66D 1/26 254/305
1,719,216 A * 7/1929 Fink ..... B66D 1/26 254/299
RE18,220 E * 10/1931 McGiffert ..... B66D 1/26 254/298
1,826,303 A * 10/1931 Dickinson ..... B61B 12/00 104/112
2,271,428 A * 1/1942 Harry ..... B66C 7/00 254/290
3,282,569 A * 11/1966 Thompson ..... B66D 1/26 254/297
3,376,981 A * 4/1968 Morrow ..... B66D 1/14 212/288
3,378,232 A * 4/1968 McIntyre ..... B66D 1/26 254/303
3,386,704 A * 6/1968 Dawson ..... B66D 1/26 254/299
3,405,878 A * 10/1968 Lawrence ..... B66D 1/26 254/297
3,436,056 A * 4/1969 Thompson ..... B66D 1/26 254/299
3,614,066 A * 10/1971 Day ..... B66D 1/26 254/299
3,733,812 A * 5/1973 Lawrence ..... B66D 1/26 74/720
3,785,504 A * 1/1974 Cheldelin ..... B66D 1/26 212/84
3,788,606 A * 1/1974 Solter ..... B66D 1/48 254/290
3,912,229 A * 10/1975 Mitchell ..... B66D 1/08 254/295
3,988,008 A * 10/1976 Morrow, Sr. ..... B66D 1/44 254/303
4,058,295 A * 11/1977 Morfitt ..... B66D 1/26 254/291
4,257,578 A * 3/1981 Allen ..... B66D 1/26 254/298
4,353,527 A * 10/1982 Langford ..... B66D 1/26 104/183
4,974,814 A * 12/1990 Cundy ..... B66D 1/24 254/342
7,140,598 B2 * 11/2006 Verakis ..... B63B 21/22 254/345
7,270,312 B1 * 9/2007 Phipps ..... B66D 1/22 254/278
7,461,832 B2 * 12/2008 Zhang ..... B66D 1/26 254/278
7,896,315 B2 * 3/2011 Faust ..... B66D 1/58 254/275
8,578,818 B2 * 11/2013 Jezek ..... B66B 11/043 74/665 GC
8,579,259 B2 * 11/2013 Okerlund ..... B66D 3/02 254/345
8,915,332 B2 * 12/2014 Jezek ..... B66B 11/043 187/250
9,051,160 B2 * 6/2015 Zheng ..... B66D 1/14
10,246,293 B2 * 4/2019 Rekieta ..... B65H 75/425
10,246,311 B2 * 4/2019 Bulling ..... B66D 1/22
10,464,791 B2 * 11/2019 Netecke ..... H02K 7/10
2006/0261205 A1 * 11/2006 Zhang ..... B66D 1/14 242/396.5
2010/0224844 A1 * 9/2010 Boussaton ..... B66D 1/7405 254/290

FOREIGN PATENT DOCUMENTS

CN 106904517 A 6/2017
CN 108383020 A 8/2018

* cited by examiner

DOUBLE-DRUM INTERMEDIATE GEAR LINKAGE WINDING TYPE HOISTING SYSTEM

CROSS-REFERENCE TO RELATED APPLICATIONS

The present application claims benefit of Chinese Patent Application No. 202010239670.4, filed on Mar. 30, 2020, and Chinese Patent Application No. 202020434779.9, filed on Mar. 30, 2020. The contents of Chinese Patent Application No. 202010239670.4 and Chinese Patent Application No. 202020434779.9 are hereby incorporated by reference in their entireties.

BACKGROUND

There are two types of existing hoisting systems. One is winding type, and the other is friction type. For the winding type, in an ultra-deep well with a depth of more than 1200 m, as the well depth increases, the proportion of the weight of the hoisting rope in the hoisted load increases rapidly, the hoisted payload becomes smaller and smaller, and the energy efficiency ratio of the hoisting system becomes lower and lower. For the friction type, a tail rope has to be used. When the depth is greater, the tail rope is longer, and the weight of the tail rope itself is heavier. When the depth of the mine well is greater than 1000 m, the proportion of the weight of the hoisting rope itself in the hoisted load increases sharply, almost all of the torque output by the drum is used to carry the weight of the tail rope, and the hoisted payload decreases sharply, that is, the energy efficiency ratio is very low. Therefore, the existing hoisting systems cannot solve the problem of low energy efficiency ratio in the hoisting system for ultra-deep well.

SUMMARY

The disclosure relates to the field of mine well equipment, and in particular to a double-drum linkage winding type hoisting system.

In view of this, an objective of the embodiment of the disclosure is to provide a double-drum linkage winding type hoisting system, which can improve the energy efficiency ratio in the hoisting system for ultra-deep well.

In order to achieve the above objective, the technical solutions of the embodiments of the disclosure are implemented as follows:

A double-drum linkage winding type hoisting system includes a first hoisting drum and a second hoisting drum; the first hoisting drum and the second hoisting drum are engaged and linked through engagement structures on outer circumferences of the first hoisting drum and the second hoisting drum or are linked through a linkage intermediate member; a first hoisting rope is wound around the first hoisting drum, a second hoisting rope is wound around the second hoisting drum, and the first hoisting rope and the second hoisting rope are not connected with each other.

In the above solution, two axial ends of the first hoisting drum and two corresponding axial ends of the second hoisting drum are aligned and linked through the linkage intermediate member; the linkage intermediate member is movably mounted at a linkage position between the first hoisting drum and the second hoisting drum; and when the linkage intermediate member moves out of the linkage position, the first hoisting drum and the second hoisting drum are out of linkage.

In the above solution, the linkage intermediate member includes a gear set which consists of one or amore cylindrical gears; the first hoisting drum is provided with teeth engaged with the cylindrical gears of the gear set on the circumference of at least one of the two axial ends of the first hoisting drum, and the second hoisting drum is provided with teeth engaged with the cylindrical gears of the gear set on the circumference of at least one of the two axial ends of the second hoisting drum.

In the above solution, the gear set at least includes two mutually engaged cylindrical gears at corresponding ends of the first hoisting drum and the second hoisting drum, opposite first sides of the two cylindrical gears are engaged with each other, and second sides of the two cylindrical gears are engaged with the first hoisting drum and the second hoisting drum, respectively.

In the above solution, the first hoisting drum is provided with teeth engaged with the cylindrical gears of the gear set on the circumferences of the two ends of the first hoisting drum, and the second hoisting drum is provided with teeth engaged with the cylindrical gears of the gear set on the circumferences of the two ends of the second hoisting drum; the gear set includes two mutually engaged cylindrical gears at the two ends of each of the first hoisting drum and the second hoisting drum, the opposite first sides of the two cylindrical gears at the same end are engaged with each other, and the second sides of the two cylindrical gears at the same end are engaged with the first hoisting drum and the second hoisting drum, respectively.

In the above solution, each of the first hoisting drum and the second hoisting drum includes an outer rotor permanent magnet motor, and a housing of a rotor of the outer rotor permanent magnet motor is a drum part of the first hoisting drum or the second hoisting drum.

In the above solution, the system further includes a power supply device capable of controlling the outer rotor permanent magnet motor of the first hoisting drum and the outer rotor permanent magnet motor of the second hoisting drum, respectively, and the power supply device is electrically connected with the outer rotor permanent magnet motor of the first hoisting drum and the outer rotor permanent magnet motor of the second hoisting drum, respectively.

In the above solution, the system further includes a control device for controlling an operation of the system and a position monitoring device for monitoring a position of a hoisting container; the control device is mounted in a ground machine room and the position monitoring device is mounted on a derrick; and the control device is electrically connected with the power supply device and the position monitoring device.

In the above solution, the system further includes an over-winding protection device, and the over-winding protection device is mounted on the derrick and electrically connected with the control device.

In the above solution, the system further includes a braking device and the braking device is mounted on one side of at least one of the first hoisting drum or the second hoisting drum.

The double-drum linkage winding type hoisting system provided by the embodiment of the disclosure includes a first hoisting drum and a second hoisting drum; the first hoisting drum and the second hoisting drum are engaged and linked through engagement structures on outer circumferences of the first hoisting drum and the second hoisting drum or are linked through a linkage intermediate member; a first hoisting rope is wound around the first hoisting drum, a second hoisting rope is wound around the second hoisting drum, and the first hoisting rope and the second hoisting rope are not connected with each other. It can be seen that, in the double-drum linkage winding type hoisting system provided by the embodiment of the disclosure, the two hoisting drums are linked. Since the force directions of the two hoisting drums are opposite, all weight of the two hoisting containers and most weight of the hoisting ropes can be offset, thus improving the energy efficiency ratio in the hoisting system for ultra-deep well.

Other beneficial effects of the embodiments of the disclosure will be further described in specific implementations in combination with specific technical solutions.

BRIEF DESCRIPTION OF THE DRAWINGS

In order to more clearly illustrate the technical solutions in the embodiments of the disclosure, the drawings required for description of the embodiments will be briefly described below. It should be understood that the drawings described below are only a part of drawings of the embodiments of the disclosure. Those skilled in the art may further obtain other drawings according to these drawings without any creative work.

DETAILED DESCRIPTION

Figure 1:
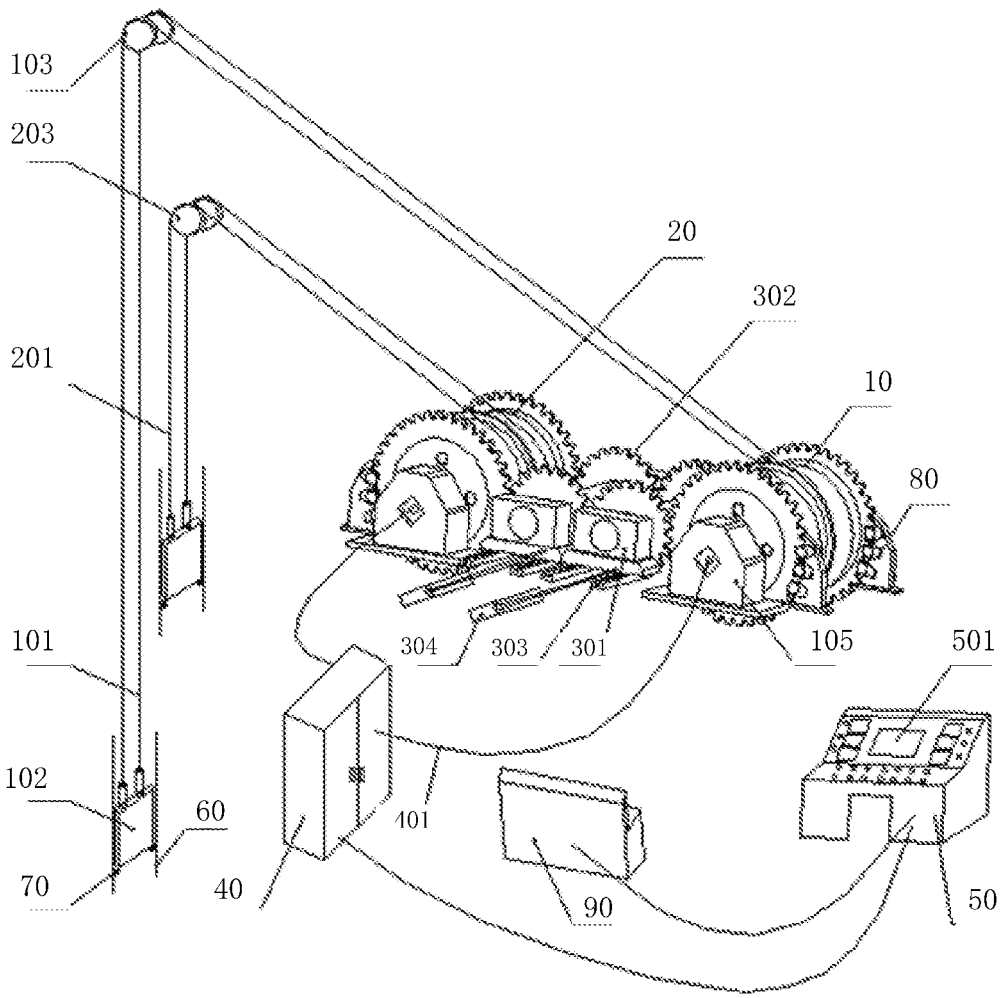
FIG. 1 illustrates a schematic view of a double-drum linkage winding type hoisting system for ultra-deep well provided by one exemplary embodiment of the disclosure.

The embodiment of the disclosure provides a double-drum linkage winding type hoisting system. The system includes a first hoisting drum and a second hoisting drum. The first hoisting drum and the second hoisting drum are engaged and linked through engagement structures on outer circumferences of the first hoisting drum and the second hoisting drum or are linked through a linkage intermediate member. A first hoisting rope is wound around the first hoisting drum. A second hoisting rope is wound around the second hoisting drum. The first hoisting rope and the second hoisting rope are not connected with each other.

Here, the hoisting drum is a winding drum. The term linkage here refers to linkage of rotation. That is, when one hoisting drum rotates, the other hoisting drum rotates synchronously. For simplicity, the first hoisting drum and the second hoisting drum are collectively referred to as the hoisting drum.

In the double-drum linkage winding type hoisting system provided by the embodiment of the disclosure, the two hoisting drums are linked. Since the force directions of the two hoisting drums are opposite, all weight of two hoisting containers and most weight of the hoisting ropes can be offset, thus improving the energy efficiency ratio in the hoisting system for ultra-deep well.

In some other embodiments of the disclosure, two axial ends of the first hoisting drum and two corresponding axial ends of the second hoisting drum are aligned and linked through the linkage intermediate member. The linkage intermediate member is movably mounted at a linkage position between the first hoisting drum and the second hoisting drum. When the linkage intermediate member moves out of the linkage position, the first hoisting drum and the second hoisting drum are out of linkage. The linkage implemented through the linkage intermediate member brings the following two beneficial effects:

First, it is convenient to release the linkage between the first hoisting drum and the second hoisting drum. That is, when the linkage intermediate member moves out of the linkage position, the linkage between the two hoisting drums can be released, to facilitate adjusting the position relationship between the hoisting containers corresponding to the two hoisting drums. In other words, when the unloading point or the loading point is not in the corresponding position, the ropes can be adjusted quickly and conveniently. This is a better implementation.

Second, the number of the linkage intermediate members can be adjusted to control the rotation directions of the hoisting drums, which is a better implementation. The rotation directions of the hoisting drums need to be adjusted according to the leading-out directions of the hoisting ropes from the hoisting drums. Referring to for example FIG. 1, the hoisting ropes are led out from the tops of the hoisting drums, and thus the number of the linkage intermediate members is appropriate. If the hoisting rope around one of the hoisting drums is led out from the bottom, one linkage intermediate member needs to be decreased or increased.

In some other embodiments of the disclosure, the linkage intermediate member includes a gear set. The gear set consists of one or more cylindrical gears. The first hoisting drum is provided with teeth engaged with the cylindrical gears of the gear set on the circumference of at least one of the two axial ends of the first hoisting drum. The second hoisting drum is provided with teeth engaged with the cylindrical gears of the gear set on the circumference of at least one of the two axial ends of the second hoisting drum. Gear is a kind of rigid linkage, so it will not slip, the linear speed of linkage is more consistent and the positions of the hoisting containers do not need to be frequently adjusted, which is a better implementation.

In some other embodiments of the disclosure, the gear set at least includes two mutually engaged cylindrical gears at corresponding ends of the first hoisting drum and the second hoisting drum. Opposite first sides of the two cylindrical gears are engaged with each other. Second sides of the two cylindrical gears are engaged with the first hoisting drum and the second hoisting drum, respectively. The two cylindrical gears enable the first hoisting drum and the second hoisting drum to be rotated in opposite directions, which meets the requirements of the floor winding type hoisting system, and is a better implementation.

In some other embodiments of the disclosure, the first hoisting drum is provided with teeth engaged with the cylindrical gears of the gear set on the circumferences of the two ends of the first hoisting drum. The second hoisting drum is provided with teeth engaged with the cylindrical gears of the gear set on the circumferences of the two ends of the second hoisting drum. The gear set includes two mutually engaged cylindrical gears at the two ends of each of the first hoisting drum and the second hoisting drum. The opposite first sides of the two cylindrical gears at the same end are engaged with each other. The second sides of the two cylindrical gears at the same end are engaged with the first hoisting drum and the second hoisting drum, respectively. That is to say, the gear set includes four cylindrical gears in total, the four cylindrical gears are fixed on two shafts respectively, and two gears on the same shaft are located at the two ends of the hoisting drum, respectively. In this way, the teeth at the two ends of the hoisting drum and the gear set are engaged more stably, the engagement reacting force is smaller, and the service life of the gear set and the teeth of the hoisting drum are improved. This is a better implementation.

In some other embodiments of the disclosure, each of the first hoisting drum and the second hoisting drum includes an outer rotor permanent magnet motor. A housing of a rotor of the outer rotor permanent magnet motor is a drum part of the first hoisting drum or the second hoisting drum.

The outer rotor permanent magnet motor has the beneficial effects such as ultra-low-frequency start and low-speed and high-torque operation. Moreover, since the rotor is a drum, no more transmission parts are needed and the start power is further reduced. This is a better implementation.

In some other embodiments of the disclosure, the system further includes a power supply device capable of controlling the outer rotor permanent magnet motor of the first hoisting drum and the outer rotor permanent magnet motor of the second hoisting drum, respectively. The power supply device is electrically connected with the outer rotor permanent magnet motor of the first hoisting drum and the outer rotor permanent magnet motor of the second hoisting drum, respectively.

In this way, by switching the power supply device, the hoisting system can be controlled to select three working states according to different situations: 1) only the first hoisting drum rotates actively, and the second hoisting drum rotates in a linked manner; 2) only the second hoisting drum rotates actively, and the first hoisting drum rotates in a linked manner; 3) the first hoisting drum and the second hoisting drum both rotate actively, and are linked at the same time. In this way, the power can be adjusted according to the load, which is more energy-saving. At the same time, the continuous working time of the driving device is reduced and the service life is longer.

In some other embodiments of the disclosure, the system further includes a control device for controlling an operation of the system and a position monitoring device for monitoring a position of a hoisting container. The control device is mounted in a ground machine room and the position monitoring device is mounted on a derrick. The control device is electrically connected with the power supply device and the position monitoring device. In this way, the control device can control the power supply device to be on/off according to the positions acquired by the position monitoring device, thereby controlling the operation of the hoisting drums. This is a better implementation.

In some other embodiments of the disclosure, the system further includes an over-winding protection device. The over-winding protection device is mounted on the derrick and electrically connected with the control device. In this way, the hoisting container can be prevented from continuously going up after reaching the wellhead and damaging facilities such as the derrick due to the inertia of the hoisting container in the hoisting process. This is a better implementation.

In some other embodiments of the disclosure, the system further includes a braking device. The braking device is mounted on one side of at least one of the first hoisting drum or the second hoisting drum. In this way, in the hoisting process, in addition to the safety braking at the loading point or unloading point under normal conditions, if there is an accident due to such as failure, the system operation can be stopped safely through the braking device. This is a better implementation. The expression "the braking device is mounted on one side of at least one of the first hoisting drum or the second hoisting drum", means that the braking device may be mounted on one side of the two hoisting drums or only on one side of any one of the two hoisting drums, because they are linked.

In order to understand the disclosure more clearly, the disclosure is further described in detail below with reference to the drawings and specific embodiments. It should be understood that the specific embodiments described herein are merely configured to illustrate the disclosure, but are not intended to limit the disclosure. Furthermore, the embodiments described below are only a part of the embodiments of the disclosure, but are not all of the embodiments. According to these embodiments, all other embodiments obtained by those skilled in the art without creative efforts fall within the protection scope of the embodiments of the disclosure.

The present embodiment provides a double-drum linkage winding type hoisting system for ultra-deep well. It can be understood that the system may be used for mine wells with other depths.

Figure 2:
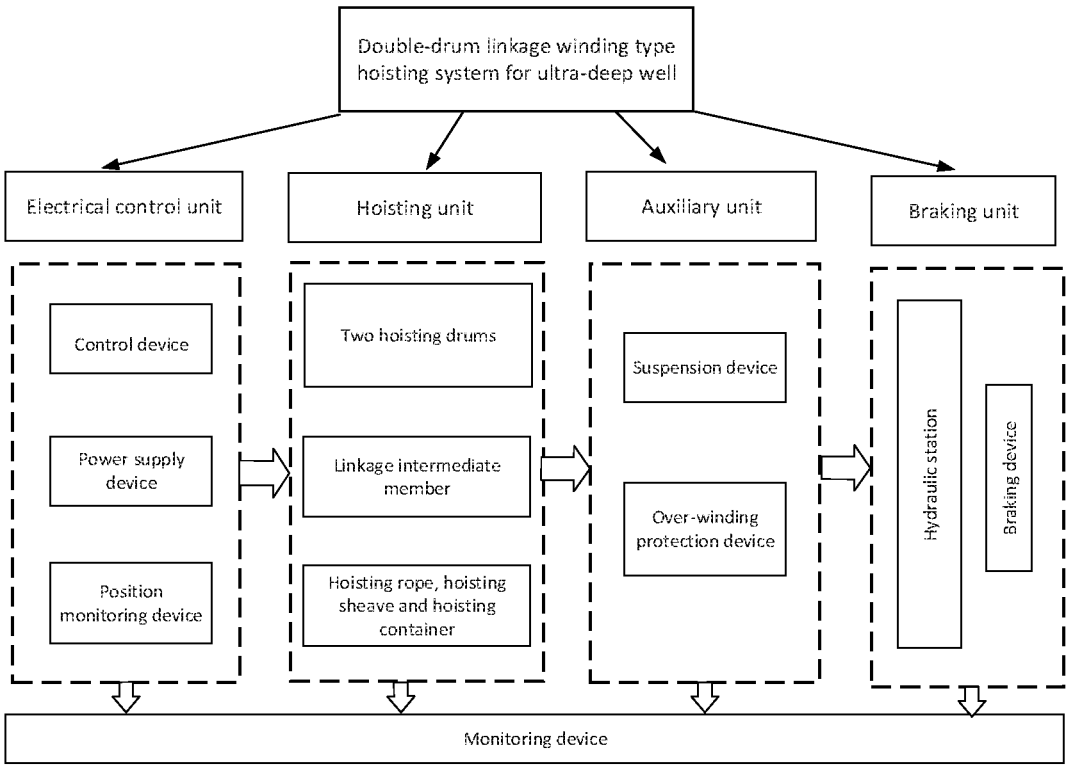
FIG. 2 illustrates a structural schematic diagram of a double-drum linkage winding type hoisting system for ultra-deep well provided by one exemplary embodiment of the disclosure.

As illustrated in FIG. 1 and FIG. 2, the system includes a first hoisting drum 10, a second hoisting drum 20, a linkage intermediate member, a first hoisting rope 101, a second hoisting rope 201, a power supply device 40, a control device 50, a position monitoring device, an over-winding protection device 70 and a braking device 80.

The first hoisting drum 10 and the second hoisting drum 20 are linked through a linkage intermediate member. The first hoisting rope 101 is wound around the first hoisting drum 10. The second hoisting rope 201 is wound around the second hoisting drum 20. The first hoisting rope 101 and the second hoisting rope 201 are not connected with each other. A hoisting container 102 is suspended under each of the first hoisting rope 101 and the second hoisting rope 201. Each of the first hoisting drum and the second hoisting drum is mounted on a drum base 105.

The linkage intermediate member is movably mounted at a linkage position between the first hoisting drum 10 and the second hoisting drum 20. When the linkage intermediate member moves out of the linkage position, the first hoisting drum 10 and the second hoisting drum 20 are out of linkage.

Figure 3:
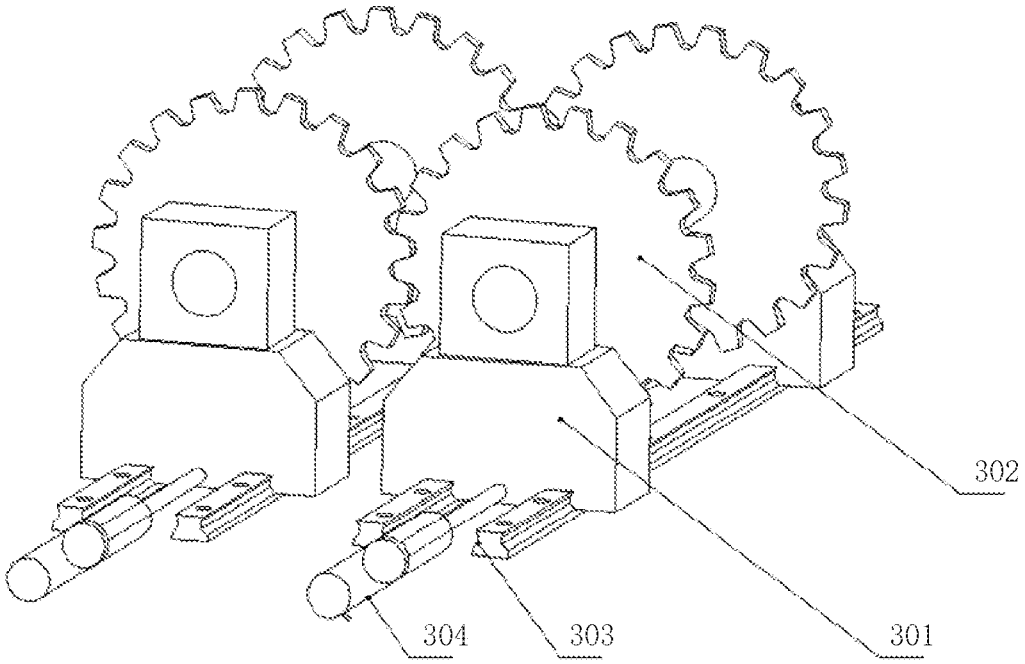
FIG. 3 illustrates a schematic view of a linkage intermediate member in a double-drum linkage winding type hoisting system for ultra-deep well provided by one exemplary embodiment of the disclosure.

Specifically, as illustrated in FIG. 3, the linkage intermediate member includes linkage bases 301 and cylindrical gears 302. The linkage bases 301 are mounted on guide rails 303. A hydraulic cylinder 304 is arranged on the outer side of each of guide rails 303. A piston rod of the hydraulic cylinder 304 is connected with the corresponding linkage base 301. That is to say, through the hydraulic cylinder 304, a translation of the linkage intermediate member can be realized, so as to release the linkage of the first hoisting drum 10 and the second hoisting drum 20.

The linkage intermediate member includes four cylindrical gears 302, which are mounted on two shafts of the linkage bases 301 respectively. Two cylindrical gears on the same shaft are located at the two ends of the hoisting drum respectively. Each of the first hoisting drum 10 and the second hoisting drum 20 is provided with teeth engaged with the cylindrical gears, on the circumferences of the two ends of each of the first hoisting drum and the second hoisting drum.

Each of the first hoisting drum 10 and the second hoisting drum 20 includes an outer rotor permanent magnet motor. A housing of a rotor of the outer rotor permanent magnet motor is a drum part of the first hoisting drum or the second hoisting drum.

The system further includes a power supply device 40 capable of controlling the outer rotor permanent magnet motor of the first hoisting drum 10 and the outer rotor permanent magnet motor of the second hoisting drum 20, respectively. The power supply device 40 is electrically connected with the outer rotor permanent magnet motor of the first hoisting drum 10 and the outer rotor permanent magnet motor of the second hoisting drum 20, respectively. Specifically, the power supply device 40 is electrically connected with the outer rotor permanent magnet motor through a wire 401.

The system further includes a control device 50 for controlling the operation of the system and a position monitoring device for monitoring the position of the hoisting container. The control device 50 is mounted in a ground machine room and the position monitoring device is mounted on a derrick 60. The control device 50 is electrically connected with the power supply device 40 and the position monitoring device. Specifically, the position monitoring device may include sensors (not shown). One sensor may be mounted at each of the loading position and unloading position. Sensors may also be mounted at other required positions.

The system further includes an over-winding protection device 70. The over-winding protection device 70 is mounted on the derrick and electrically connected with the control device 50. If the hoisting container exceeds a preset depth due to inertia and other reasons, the over-winding protection device 70 will start automatically.

The system further includes a braking device 80. The braking device 80 is mounted on one side of each of the first hoisting drum 10 and the second hoisting drum 20. Specifically, the braking device 80 may be matched with the position monitoring device. For example, when the hoisting container reaches the loading position or unloading position, the sensor will send a signal back to the control device 50, which instructs the braking device 80 to act.

Specifically, the drum parts of the two hoisting drums are provided with two winding areas. One hoisting rope is wound around each of the winding areas. That is to say, the first hoisting rope 101 includes two hoisting ropes, arranged in parallel, one end of each of the two hoisting ropes is wound around the first hoisting drum 10, and the other end of each of the two hoisting ropes passes around a hoisting sheave 103 then is connected to the hoisting container and finally is connected to the top of the same hoisting container. Compared with single rope connection, two hoisting ropes can effectively reduce the maximum static tension of the hoisting rope in deep well hoisting, and can reduce the diameter of the hoisting rope and the diameter of the hoisting drum.

Similarly, the second hoisting rope 201 also includes two hoisting ropes arranged in parallel. One end of each of the two hoisting ropes is wound around the second hoisting drum 20, and the other end of each of the two hoisting ropes passes around a hoisting sheave 203 and then is connected to the hoisting container. The second hoisting rope has a leading-out direction that is the same as that of the first hoisting rope 101 from the first hoisting drum 10. More specifically, during working, the second hoisting drum 20 is powered on, and the first hoisting drum 10 is not powered on. When the second hoisting drum 20 rotates, the torque is transmitted to the first hoisting drum 10 through the linkage intermediate member. Since the two hoisting drums transmit the torque through the linkage intermediate member, it is very convenient to realize the synchronous linkage between the two hoisting drums. When the first hoisting rope 101 is unwound, the second hoisting rope 201 is wound. That is to say, the two hoisting containers may be located in the well at the same time, one is used for loading and the other is used for unloading, thereby improving the working efficiency of the ultra-deep well hoisting system.

More importantly, in the hoisting process, the two hoisting drums are connected through the linkage intermediate member. The rotation directions of the two hoisting drums are opposite and the leading-out directions of ropes from the two hoisting drums are the same. According to the principle that the anticlockwise torque and the clockwise torque can offset each other, the weight of the hoisting containers and a part of the hoisting ropes wound around the two hoisting drums can offset each other, which greatly reduces the load borne by the hoisting drums, such that almost all the power consumed by the hoisting system is transformed into the hoisted payload in each cycle, and the energy-saving effect is very remarkable.

It can be understood that the above working process may also be as follow: the first hoisting drum 10 is powered on, the second hoisting drum 20 is not powered on, and the achieved energy-saving effect is the same.

Specifically, a suspension device illustrated in FIG. 2 is mounted on the hoisting container to enable the hoisting container to be more balanced during hoisting.

Figure 4:
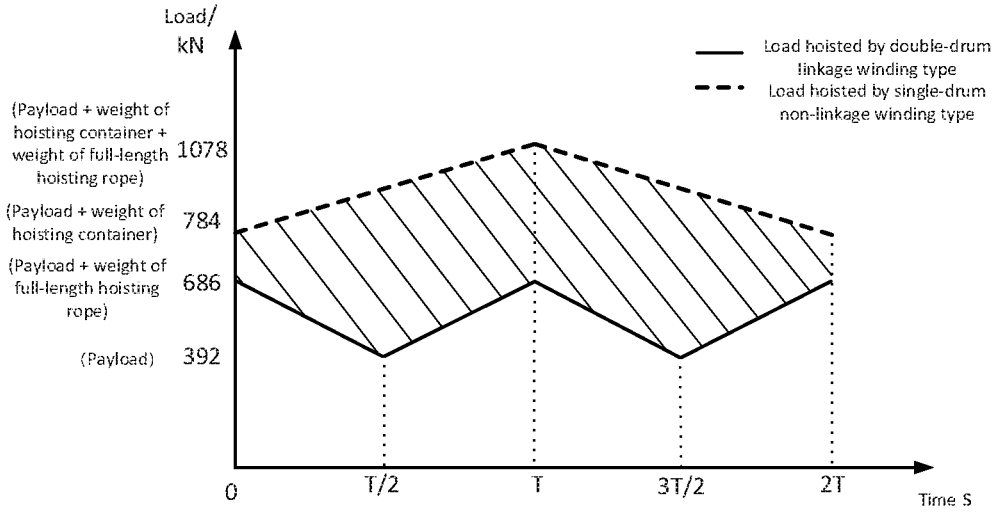
FIG. 4 illustrates a schematic chart of load comparison between a double-drum linkage winding type hoisting system for ultra-deep well provided by one exemplary embodiment of the disclosure and a conventional non-linkage winding type hoisting system.

In order to better understand the above effect of offsetting the weight of the hoisting container and that of most of the hoisting ropes by linking the two hoisting drums, description will be made below through examples. Referring to FIG. 4, it is assumed that the mass of the hoisting container is m=40 t, the mass of the hoisted material is $m_1$=40 t, the mass per unit length of the hoisting rope is $\rho$=10 kg/m, the maximum hoisting height is L=1500 m, the gravity acceleration g is 9.8 $m/s^2$, and the complete lowering and hoisting time cycle is 2 T. When the hoisting drums work separately and is not linked through the linkage intermediate member, the minimum hoisted load of the hoist is (m+m1)g and the maximum hoisted load is $(m+m_1)g+2\rho gl$. When the two hoisting drums are linked by the linkage intermediate member, the mass of the two hoisting containers can be balanced, and the minimum hoisted load is $m_1g$ and the maximum hoisted load is $m_1g+2\rho gL$ in the operation process. The calculation results show that the minimum load borne by a single hoisting drum is 784 kN under the situation of no linkage; and the maximum load borne by the whole hoisting system is 686 kN under the situation of linkage through the linkage intermediate member. That is, the maximum load borne by the whole system under the situation of linkage is even smaller than the minimum hoisted load borne by a single hoisting drum under the situation of no linkage.

Further, when the double-drum linkage winding type hoisting system for ultra-deep well works, there are two working states. One working state is that one of the two hoisting drums rotates actively, the other rotates by linkage. That is, one of the two hoisting drums is powered on, the other is not powered on but is in a standby state such that it can enter the working state at any time, or in other words, one of the two hoisting drums is for main use and one is for hot standby. The other working state is that the two hoisting drums rotate actively. In other words, the two hoisting drums are powered on. That is, both of them are for main use. The two working states can be switched at any time. If a hoisting drum being powered on fails, the power supply thereof may be cut off, and the hoisting drum may be switched into hot standby state. Then, the other hoisting drum originally in the hot standby state can be powered on to generate torque and thus be switched into the main use state. In this way, it is ensured that the hoisting system will not stop working due to the failure of one of the hoisting drums, and thus the working efficiency of the hoisting system is higher.

Here, hot standby is a technical term relative to cold standby, and refers to operation with a target device. When the target device fails or stops, the hot standby device immediately undertakes the work task of the failed device. Cold standby refers to that, after the target device fails or stops, the cold standby device starts to enter a started and operating state from a stopped and standby state, and undertakes the work task of the failed device.

In addition, after the long-term operation of the two hoisting drums, the positions of the two hoisting containers may not match. For example, when one hoisting container reaches the loading point, the other hoisting container may not reach the unloading point. The independent adjustments on ropes of the two hoisting containers can be realized by adjusting the position of the linkage intermediate member. At this time, the hoist may be braked by the braking device to stop operating. A hydraulic station 90 supplies oil to the hydraulic cylinder, the supplied oil pushes the piston rod to move the support base on the guide rail, and then the linkage intermediate member is driven to be disengaged from the hoisting drum. Then, the two hoisting drums are started and their hoisting containers are adjusted to reach the designated positions. Finally, the hydraulic cylinder is used again to push the linkage intermediate member back to the previous linkage position. In this way, it is very convenient and fast to realize the adjustments on ropes around the two hoisting drums.

In the double-drum linkage winding type hoisting system for ultra-deep well provided by the present embodiment, since the hoisting drums are driven by permanent magnet motors, the low-frequency stable start of the hoisting system can be realized. Further, the large and stable torque and the small power during starting ensure the stable and reliable start of the hoist under heavy load, solve the problem that the torque of the asynchronous motor is small during starting and the motor starts by overload, and avoid the situation that "a big horse draws a small carriage" since a high-power motor start method is usually selected when the asynchronous motor starts.

In order to better understand the disclosure, description will be made through examples. For example, it is assumed that the hoisting height of a mine well is 1200 m, each hoisting container is connected by two hoisting ropes, the unit mass of each of the two hoisting ropes is 6.8 kg/m, hoisting speed is 3 m/s, the mass of the hoisting container is 30 t and the diameter of the drum is 5 m. Assuming that the mass of the hoisted materials are 10 t, 20 t, 30 t and 40 t, respectively, the start powers required by the double-drum linkage winding type hoisting system for ultra-deep well in the embodiment of the disclosure and the ordinary non-linkage asynchronous motor type hoisting system are calculated respectively. The speed of the asynchronous motor is 348 r/min.

Start power of non-linkage asynchronous motor:

$$P = c\frac{N_e M_d}{9550 i\eta} = c\frac{N_e F D}{19100 i\eta} \tag{1}$$

where c is current influence factor of asynchronous motor, with a value of 2; Ne is speed of asynchronous motor; Md is driving torque of motor; i is transmission ratio of reducer; D is diameter of drum; F is the maximum static tension of hoisting rope; η is transmission efficiency, with a value of 0.92; values of coefficients in the formula can be found in the standards for motor design.

Start power of double-drum linkage winding type hoisting system for ultra-deep well:

$$P = c\frac{kF_J V}{1000\eta}\rho \tag{2}$$

where c is low-frequency start current influence factor of permanent magnet motor, with a value of 1.6; K is margin coefficient of motor, with a value of 1.1; η is transmission efficiency, with a value of 1 for permanent magnet motor; V is hoisting speed; p is influence factor of heating during acceleration and deceleration of motor, with a value of 1; similarly, the values of coefficients in the formula can be found in the standards for motor design.

The data in Table 1 below are obtained by calculating the start powers according to formulas (1) and (2). Comparing the start powers fully indicates that the start power of the double-drum linkage winding type hoisting system for ultra-deep well in the embodiment of the disclosure is smaller and thus the start of the hoisting system of the disclosure is more stable. Specifically, the hoisting ropes are steel wire ropes.

| Load (t) | 10 | 20 | 30 | 40 |
|---|---|---|---|---|
| Double-drum linkage type start power of permanent magnet outer rotor hoist (kW) | 1362 | 1880 | 2397 | 2914 |
| Non-linkage type start power of asynchronous motor (kW) | 3596 | 4234 | 4872 | 5510 |

Further, the whole hoisting process can be monitored by the control device 50. The control device 50 is connected with the power supply device 40, the hydraulic station 90 and a host computer 501. The control device 50 has the functions of monitoring and recording the working state and real-time operating data of the whole hoisting system, generating, storing and printing system reports, and configuring the power supply system. The configuration includes high-voltage power distribution system, low-voltage power distribution system, etc. The control device 50 is provided with a monitor. The monitor can display the switching states of the gate system and the mineshaft, the rotation speed of the hoisting drum, the position of the hoisting container, the motor current, and the dynamic curve, etc.

Further, a frequency conversion component is arranged beside the power supply device 40 to reduce the frequency and realize low-speed start when the motor is started. The start power of the double-drum linkage winding type hoisting system for ultra-deep well in the present embodiment is also much smaller than that of the ordinary asynchronous motor type hoisting system.

The hydraulic station 90 is configured to provide hydraulic power to the hydraulic cylinder 304.

In the description of the embodiments of the disclosure, unless otherwise stated and limited, the term "connection" should be understood in a broad sense. For example, the connection may be electrical connection, or internal connection between two components, or direct connection, or indirect connection through an intermediate medium. For those skilled in the art, the specific meanings of the above term may be understood according to specific situations.

In the embodiments of the disclosure, if the term "first\second\third" is involved, it only distinguishes similar objects, and does not represent a specific ordering of objects. It can be understood that the "first\second\ third" may be interchanged in a specific order or a precedence order if allowed.

It should be understood that "an embodiment" or "some embodiments" mentioned throughout the specification means that specific features, structures or characteristics related to the embodiments are included in at least one embodiment of the disclosure. Thus, the appearances of "in one embodiment" or "in some embodiments" throughout the specification are not necessarily referring to the same embodiment. Furthermore, these specific features, structures or characteristics may be combined in one or more embodiments in any suitable mode. It should be understood that in various embodiments of the disclosure, the magnitude of the serial number of each of the above processes does not mean an execution order. The execution order of each process should be determined by its functions and internal logics, and should not constitute any limitation on the implementation processes of the embodiments of the disclosure. The serial numbers of the above embodiments of the disclosure are merely for description, and do not represent the superiority or inferiority of the embodiments.

The embodiments described above are merely preferred embodiments of the disclosure, and are not intended to limit the protection scope of the disclosure. Any modification, equivalent replacement and improvement made within the spirit and principle of the disclosure are intended to be included within the protection scope of the disclosure.

The invention claimed is:

1. A double-drum linkage winding type hoisting system, wherein the system comprises a first hoisting drum and a second hoisting drum, the first hoisting drum and the second hoisting drum are engaged and linked through engagement structures on outer circumferences of the first hoisting drum and the second hoisting drum or are linked through a linkage intermediate member; a first hoisting rope is wound around the first hoisting drum, a second hoisting rope is wound around the second hoisting drum, and the first hoisting rope and the second hoisting rope are not connected with each other, wherein the linkage intermediate member comprises a gear set, the gear set consisting of one or more cylindrical gears; and wherein the first hoisting drum is provided with teeth engaged with the corresponding cylindrical gear of the gear set on a circumference of at least one of two axial ends of the first hoisting drum, and the second hoisting drum is provided with teeth engaged with the corresponding cylindrical gear of the gear set on a circumference of at least one of two axial ends of the second hoisting drum; wherein the two axial ends of the first hoisting drum and the two corresponding axial ends of the second hoisting drum are aligned and linked through the linkage intermediate member; the linkage intermediate member comprises at least one linkage base mounted on at least one guide rails allowing for the linkage intermediate member to be movably in and out of a linkage position between the first hoisting drum and the second hoisting drum.

2. The double-drum linkage winding type hoisting system according to claim 1, wherein the gear set at least comprises two mutually engaged cylindrical gears at corresponding ends of the first hoisting drum and the second hoisting drum, opposite first sides of the two mutually engaged cylindrical gears are engaged with each other, and second sides of the two mutually engaged cylindrical gears are engaged with the first hoisting drum and the second hoisting drum, respectively.

3. The double-drum linkage winding type hoisting system according to claim 2, wherein the teeth of the first hoisting drum are engaged with the cylindrical gears of the gear set on the circumferences of the two axial ends of the first hoisting drum, and the teeth of the second hoisting drum are engaged with the cylindrical gears of the gear set on the circumferences of the two axial ends of the second hoisting drum; the gear set comprises two mutually engaged cylindrical gears at the two axial ends of each of the first hoisting drum and the second hoisting drum, the opposite first sides of the two cylindrical gears at the same end are engaged with each other, and the second sides of the two cylindrical gears at the same end are engaged with the first hoisting drum and the second hoisting drum respectively.

4. The double-drum linkage winding type hoisting system according to claim 3, wherein each of the first hoisting drum and the second hoisting drum comprises an outer rotor permanent magnet motor, and a housing of a rotor of the outer rotor permanent magnet motor is a drum part of the first hoisting drum or the second hoisting drum.

5. The double-drum linkage winding type hoisting system according to claim 4, wherein the double-drum linkage winding type hoisting system further comprises a power supply device capable of controlling the outer rotor permanent magnet motor of the first hoisting drum and the outer rotor permanent magnet motor of the second hoisting drum, respectively, and the power supply device is electrically connected with the outer rotor permanent magnet motor of the first hoisting drum and the outer rotor permanent magnet motor of the second hoisting drum, respectively.

6. The double-drum linkage winding type hoisting system according to claim 5, wherein the double-drum linkage winding type hoisting system further comprises a control device for controlling an operation of the double-drum linkage winding type hoisting system and a position monitoring device for monitoring a position of a hoisting container; the control device is mounted in a ground machine room and the position monitoring device is mounted on a derrick; and the control device is electrically connected with the power supply device and the position monitoring device.

7. The double-drum linkage winding type hoisting system according to claim 6, wherein the double-drum linkage winding type hoisting system further comprises an over-winding protection device and the over-winding protection device is mounted on the derrick and electrically connected with the control device.

8. The double-drum linkage winding type hoisting system according to claim 7, wherein the double-drum linkage winding type hoisting system further comprises a braking device and the braking device is mounted on one side of at least one of the first hoisting drum or the second hoisting drum.

* * * * *